United States Patent [19]

Smith

[11] Patent Number: 4,693,480

[45] Date of Patent: Sep. 15, 1987

[54] COLOR-CODED CARD GAME

[76] Inventor: Randolph Smith, 682 Pryor St., SW., Atlanta, Ga. 30315-1042

[21] Appl. No.: 746,130

[22] Filed: Jun. 18, 1985

[51] Int. Cl.[4] ..... A63F 1/00

[52] U.S. Cl. ..... 273/296; 273/148 R

[58] Field of Search ..... 273/148 R, 292, 293, 273/296, 303, 304, 305, 306

[56] References Cited

U.S. PATENT DOCUMENTS

| | | | |
|---|---|---|---|
| 1,373,998 | 4/1921 | Dillon | 273/296 |
| 1,410,922 | 3/1922 | Johnson | 273/292 |
| 1,443,346 | 1/1923 | Coble | 273/292 |
| 1,632,941 | 6/1927 | Abell | 273/303 |
| 2,562,633 | 7/1951 | Needham | 273/292 X |
| 4,119,322 | 10/1978 | Weigl | 273/293 |

*Primary Examiner*—Anton O. Oechsle

[57] ABSTRACT

This invention is a new kind of card game that will make the players feel very happy because the game is easy to play since the symbol (ball, octagon, star, triangle, or wall) and the single color on the face of each card tell each one of two players when to buy, owe, sell, trade, or wind two cards. The dealer controls or instructs all players so the game will always be easy to play, and serial numbers on the cards and colored coins prevents cheating and disencourages trying to cheat. A player wins by showing the dealer at a certain time any number of cards that equal 3 whole matching colors. Card game toys (the colored bank, the colored stick-tray, and the players' assemble card) help the dealer control the players in every game and the other card game toys help the players follow the instructions of the dealer since the said toys are ID (identification) tags and colored coins. Players without enough cards and/or colored coins are eliminated from the game.

1 Claim, 10 Drawing Figures

COLOR-CODED CARD GAME

BRIEF SUMMARY OF THE INVENTION

In most card games, a player has to already know how to play the games before he can enter them. He must be able to read the alphabets or words on the face of each card before he can play one of them, and other players can cheat him by secretly playing partners or by slipping or hiding cards from other decks of the same kind of card game, then using those cards to try to win the games.

My invention overcomes the disadvantages of the prior art by introducing a card game with one kind of serial number on the back of each card so regular players and cardsharps can not cheat by illegally using cards from other decks to try to win the games. Each whole card game has only one kind of serial number that is a different kind of serial number when compared to any serial numbers used by the same kind of other card games. Since the color(s) on the face of each card are instructions for each 2 players and the symbol on the face of each card tells each 2 players when to buy, sell, trade, owe, or win 2 cards, players can not cheat by trying to play partners because they can not play as partners. Since each card contains color(s) and/or a symbol (ball, star, octagon, triangle, or wall) and no alphabets or words, anybody, including illiterate children or adults, can play the game immediately. Because the dealer regulates the game by directing or supervising each 2players, anybody who knows nothing about the game can still enter the game immediately after being told, "three whole colors win the colored coins from the 1st bank, or from the 2nd bank if the 1st bank is empty. The dealer will show you what to do after he deals the cards to you."

DETAILED DESCRIPTION OF THE DRAWINGS

Figure 1:
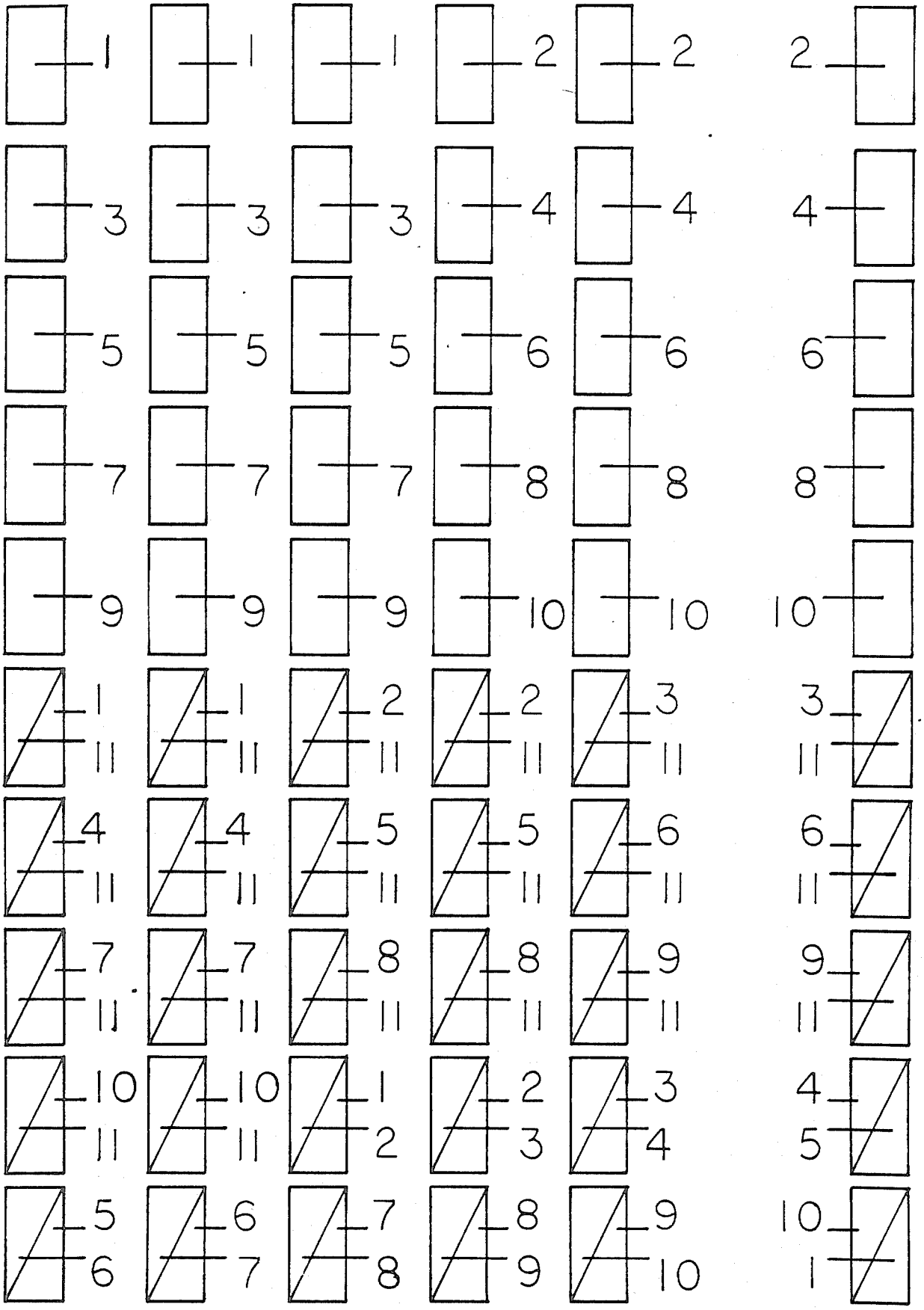
FIG. 1 is a cross-sectional engineering drawing that shows the front view (or face) of each card in deck number one.
Figure 2:
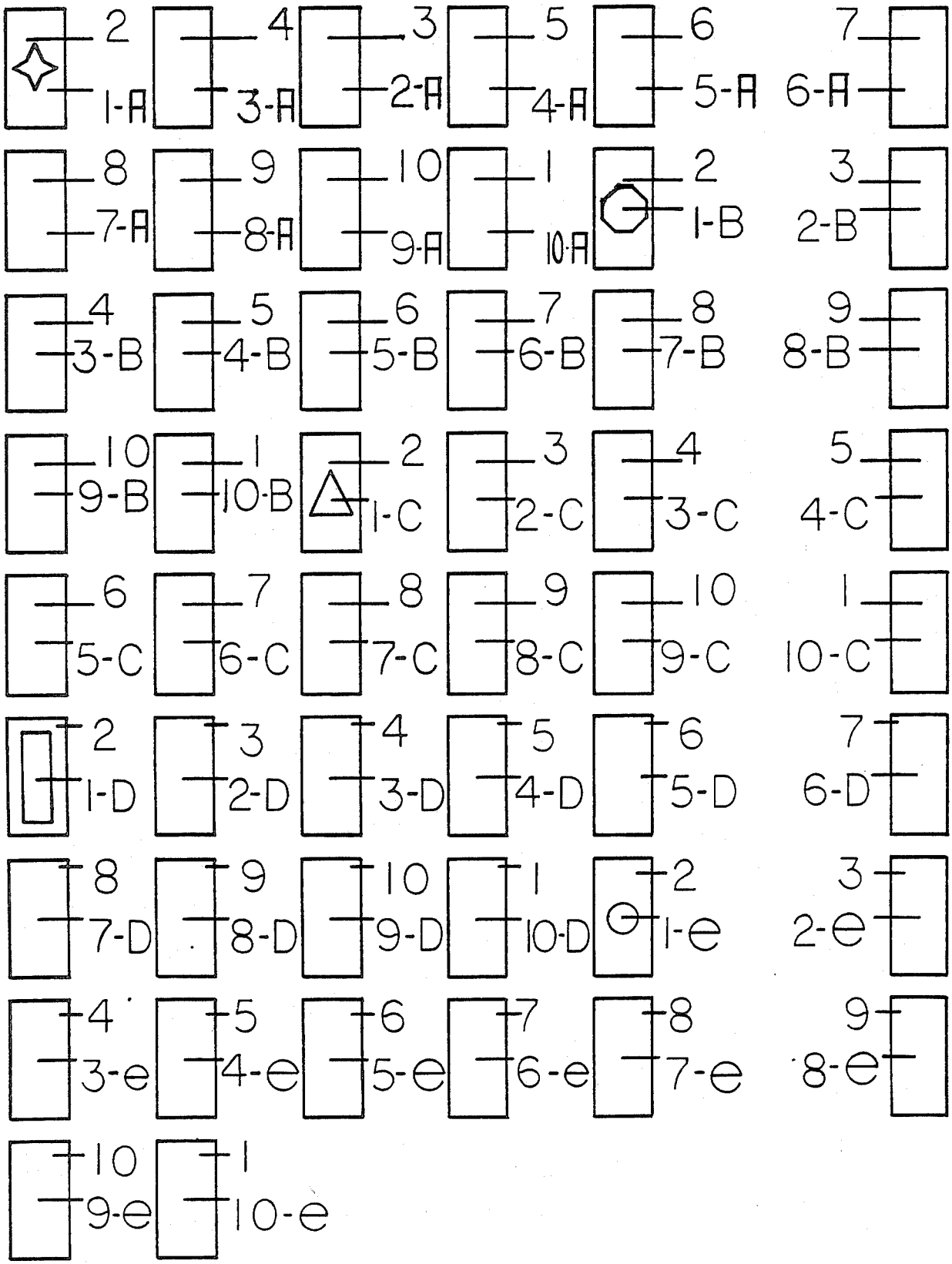
FIG. 2 is a cross-sectional engineering drawing that shows the front view (or face) of each card in deck number two.
Figure 3:
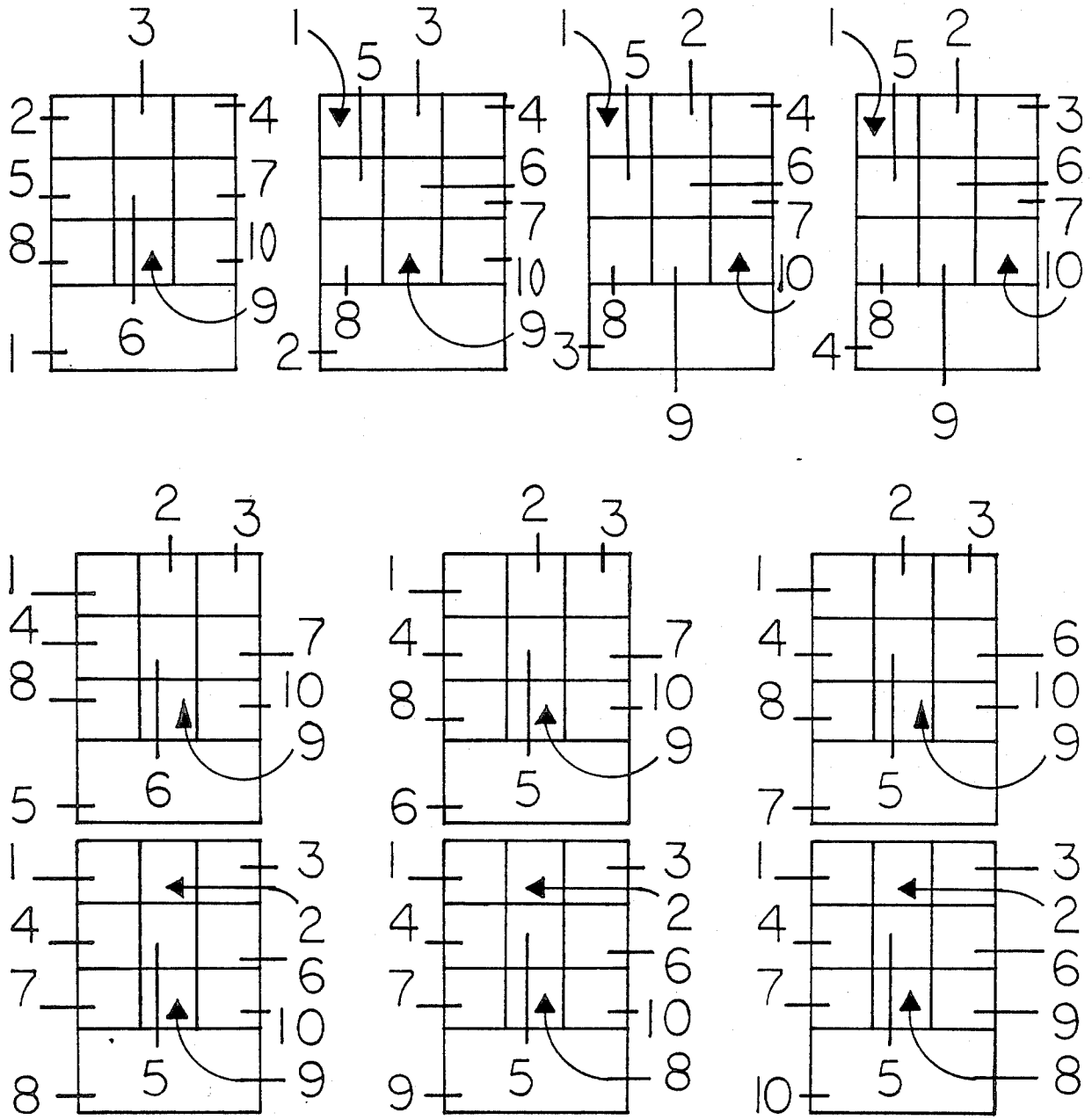
FIG. 3 is a cross-sectional engineering drawing that shows the front view (or face) of each other card in deck number two.

FIG. 1 shows each one of the sixty playing cards to deck number one and each one of the said cards are $4\frac{1}{4}''$ tall and $2\frac{1}{2}''$ wide. FIG. 2 shows fifty and FIG. 3 shows ten of the sixty playing cards to deck number two. Each one of the said cards are 4" tall and $2\frac{3}{4}''$ wide. When reference numerals (1–13) refer to cards (shown in FIGS. 1–3), each said numeral describes the color of the surface (as shown in FIG. 1), background (as shown in FIG. 2), or square (as shown in FIG. 3). In FIG. 1, there are ten rows of cards with 6 cards in each row. On each card in the 6th–10th row a diagonal line runs from the upper right corner to the lower left corner to separate the two different colors. In FIG. 3, on each card there are 3 rows of squares with 3 squares in each row (a total of 9 11/12" squares). A reference numeral shows the color of each square or the color of the surface below the bottom row (3rd row) of squares on the face of each card. When reference numerals (1–3) refer to one of the card game toys (as shown in FIGS. 6–10), each said numeral describes the color of a whole surface, except for the said numerals in FIGS. 9–10 where the large arrow(s) indicate that each one of the whole toys is only one color. In FIG. 1, each one of the cards in the 1st–5th row contains a single surface and each one of the cards in the6th–10th row contains a double (divided) surface. In FIG. 2, each card contains a single background, and one symbol (ball, octagon, star, triangle, or wall) in the foreground. Each one of all cards in deck numbers 1 and 2 contains a glossy face with an elastic body made of high-quality cardboard. Each one of the reference characters (1-A–10-A, 1-B–10-B, 1-C–10-C, 1-D–10-D, **1-*e*–10-*e*) shown in FIG. 2** is the symbol (ball, octagon, star, triangle, or wall) on the face of each card and each symbol should be placed in a centered location between both of the side edges, the top edge, and the bottom edge of each card. Therefore:

1—colored red.
2—colored yellow.
3—colored blue.
4—colored brown.
5—colored green.
6—colored yellow-green.
7—colored orange.
8—colored carnation pink.
9—colored violet.
10—colored black.
11—colored white.
12—colored silver.
13—colored gold.
1-A—A red star.
2-A—A yellow star.
3-A—A blue star.
4-A—A brown star.
5-A—A green star.
6-A—A yellow-green star.
7-A—An orange star.
8-A—A carnation-pink star.
9-A—A violet star.
10-A—A black star.
1-B—A red octagon.
2-B—A yellow octagon.
3-B—A blue octagon.

4-B—A brown octagon.
5-B—A green octagon.
6-B—A yellow-green octagon.
7-B—An orange octagon.
8-B—A carnation-pink octagon.
9-B—A violet octagon.
10-B—A black octagon.
1-C—A red triangle.
2-C—A yellow triangle.
3-C—A blue triangle.
4-C—A brown triangle.
5-C—A green triangle.
6-C—A yellow-green triangle.
7-C—An orange triangle.
8-C—A carnation-pink triangle.
9-C—A violet triangle.
10-C—A black triangle.
1-D—A red vertical rectangle.
2-D—A yellow vertical rectangle.
3-D—A blue vertical rectangle.
4-D—A brown vertical rectangle.
5-D—A green vertical rectangle.
6-D—A yellow-green vertical rectangle.
7-D—An orange vertical rectangle.
8-D—A carnation-pink vertical rectangle.
9-D—A violet vertical rectangle.
10-D—A black vertical rectangle.
1-*e*—A red ball.
2-*e*—A yellow ball.
3-*e*—A blue ball.
4-*e*—A brown ball.
5-*e*—A green ball.
6-*e*—A yellow-green ball.
7-*e*—An orange ball.
8-*e*—A carnation-pink ball.
9-*e*—A violet ball.
10-*e*—A black ball.
1-F—A red belt that is extremely narrow and very thin and it is made of inexpensive cloth with a metal or plastic buckle so the belt can fit comfortably around the card player's neck. The belt should fit anybody's neck.
2-F—The same as 1-F, except the belt is yellow.
3-F—The same as 1-F, except the belt is blue.
4-F—The same as 1-F, except the belt is brown.
5-F—The same as 1-F, except the belt is green.
6-F—The same as 1-F, except the belt is yellow-green.
7-F—The same as 1-F, except the belt is orange.
8-F—The same as 1-F, except the belt is carnation pink.
9-F—The same as 1-F, except the belt is violet.
10-F—The same as 1-F, except the belt is black.
11-F—The same as 1-F, except the belt is white.
A—A small hole so a string of beads B can fit through it.
B—A string of beads that is fastened into a loop, being a ½" circle.
C—A thick rubber band the size of 1" circle that is a single loop which fits through both the loop of the lower string of beads B and the higher string of beads B while the higher string of beads B fits through the loop of the belt too.
D—Both words "THE DEALER" printed in each gold alphabet 1" tall upon the dealer's ID tag.
E—Both words "RED PLAYER" printed in each white alphabet 1½" tall upon the player's ID tag.
F—Both words "BLUE PLAYER" printed in each white alphabet 1½" tall upon the player's ID tag.
G—Both words "GREEN PLAYER" printed in each white alphabet 1½" tall upon the player's ID tag.
H—Both words "ORANGE PLAYER" printed in each white alphabet 1½" tall upon the player's ID tag.
i—Both words "VIOLET PLAYER" printed in each white alphabet 1½" tall upon the player's ID tag.
J—Both words "YELLOW PLAYER" printed in each white alphabet 1¼" tall upon the player's ID tag.
K—Both words "BROWN PLAYER" printed in each white alphabet 1¼" tall upon the player's ID tag.
L—Both words "YELLOW-GREEN PLAYER" printed in each white alphabet 1¼" tall upon the player's ID tag.
M—Both words "CARNATION-PINK PLAYER" printed in each white alphabet 1¼" tall upon the player's ID tag.
N—Both words "BLACK PLAYER" printed in each white alphabet 1¼" tall upon the player's ID tag.
O—The serial number printed upright in red-violet number(s) with its red-violet alphabet.
P—The serial number printed upside down in red-violet number(s) with its red-violet alphabet. When any card is held upside down, its upside-down serial number P will simultaneously appear in the upright position with the upright serial number 0 appearing in the upside-down position.
Q—The capitalized words and the number "DECK NO. 1" printed in red-violet color (of the alphabets and the numeral 1).
R—The capitalized words and the number "DECK NO. 2" printed in red-violet color (of the alphabets and the numeral 2).
1-G—The capitalized word and the number "1st BANK" printed in Red-violet color upon the white rectangular-shaped label.
2-G—The capitalized word and the number "2ND BANK" printed in red-violet color upon the white rectangular-shaped label.
3-G—The lid that covers only the 2nd bank.
4-G—The handle of the 1st lid.
5-G—One of the four rectangular-shaped openings so colored coins can be dropped through each or any one of the four said openings.
6-G—The bottom or floor of the 1st bank.
7-G—The bottom or floor of the 2nd bank.
8-G—The handle of the 2nd lid.
9-G—The lid that covers only the 1st lid.
10-G—The hinge which supports only the 1st lid.
11-G—The hinge which supports only the 2nd lid.

Figure 4:
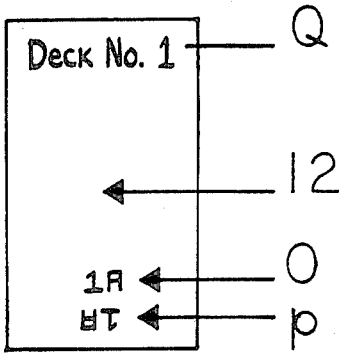
FIG. 4 is a cross-sectional engineering drawing that shows the rear view (or back) of each card in deck number one.

FIG. 4 shows the rear view of each card in deck number one. Each card is 4¼" tall and 2½" wide.

Figure 5:
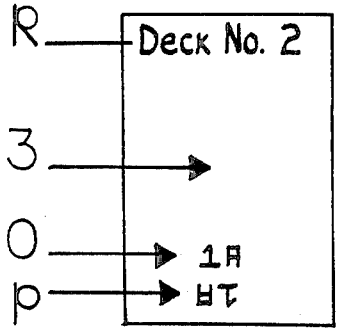
FIG. 5 is a cross-sectional engineering drawing that shows the rear view (or back) of each card in deck number two.

FIG. 5 shows the rear view of each card in deck number two. Each card is 4" tall and 2¾" wide.

Figure 6:
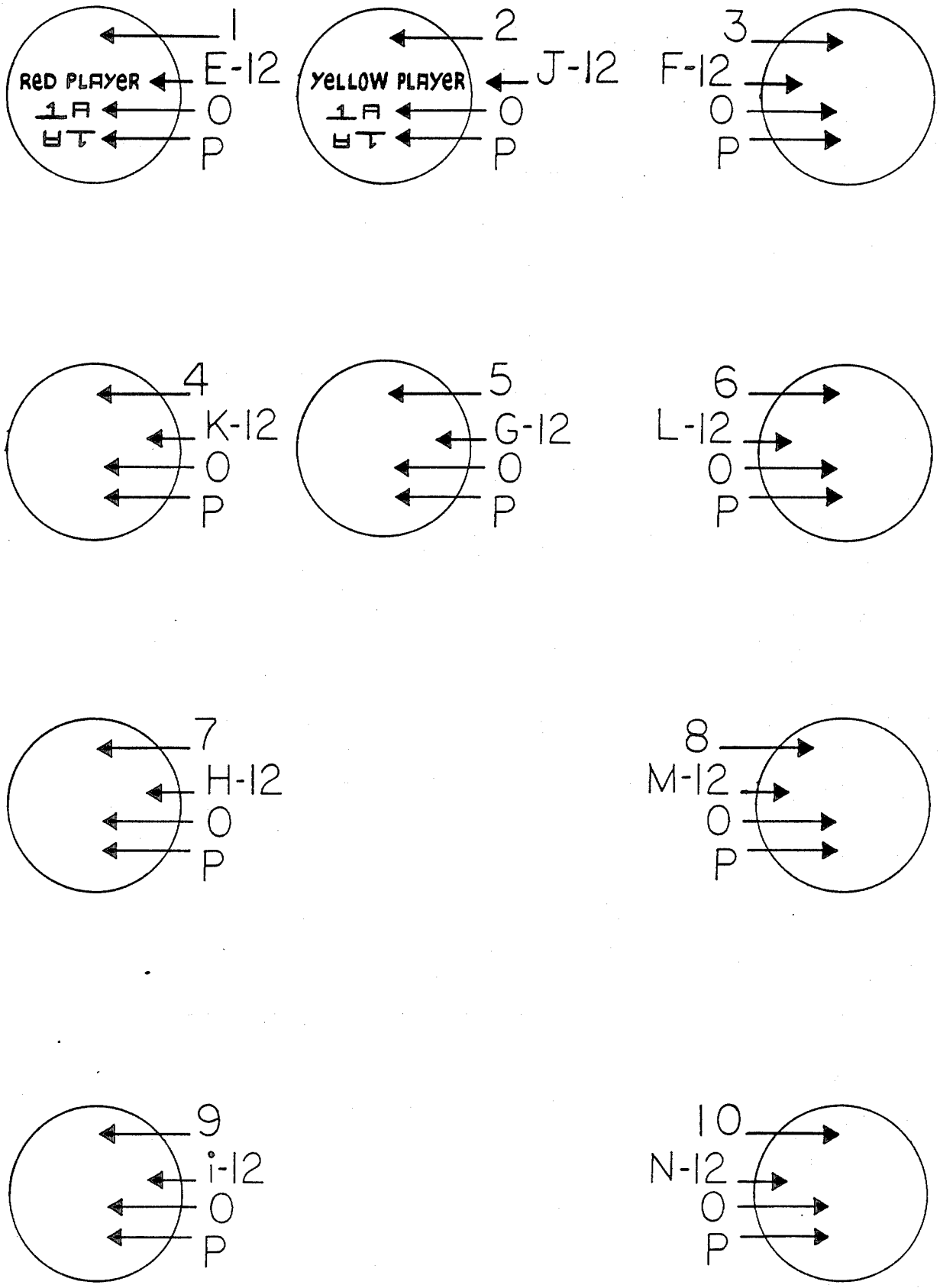
FIG. 6 is a cross-sectional engineering drawing that shows the front view and the back view simultaneously of each colored coin.

FIG. 6 shows how the front view and the back view of each one of the ten different kinds of colored coins should appear. There are ten of the same kind of coins to each one of the ten different kinds of coins, meaning there are a total of one hundred colored coins to a whole card game. Each coin is the size of a 1½" circle being 1/16" thick and made of hard plastic or elastic rubber.

FIG. 6 also contain the reference characters written below. Therefore:

E-12—Both words "RED PLAYER" printed in each white alphabet . . . ⅛" tall upon the colored coin.
J-12—Both words "YELLOW PLAYER" printed in each white alphabet ⅛" tall upon the colored coin.

F-12—Both words "BLUE PLAYER" printed in each white alphabet $\frac{1}{8}''$ tall upon the colored coin.

K-12—Both words "BROWN PLAYER" printed in each white alphabet $\frac{1}{8}''$ tall upon the colored coin.

G-12—Both words "GREEN PLAYER" printed in each white alphabet $\frac{1}{8}''$ tall upon the colored coin.

L-12—Both words "YELLOW-GREEN PLAYER" printed in each white alphabet $\frac{1}{8}''$ tall upon the colored coin.

H-12—Both words "ORANGE PLAYER" printed in each white alphabet $\frac{1}{8}''$ tall upon the colored coin.

M-12—Both words "CARNATION-PINK PLAYER" printed in each white alphabet $\frac{1}{8}''$ tall upon the colored coin.

i-12—Both words "VIOLET PLAYER" printed in each white alphabet $\frac{1}{8}''$ tall upon the colored coin.

N-12—Both words "BLACK PLAYER" printed in each white alphabet $\frac{1}{8}''$ tall upon the colored coin.

Figure 7:
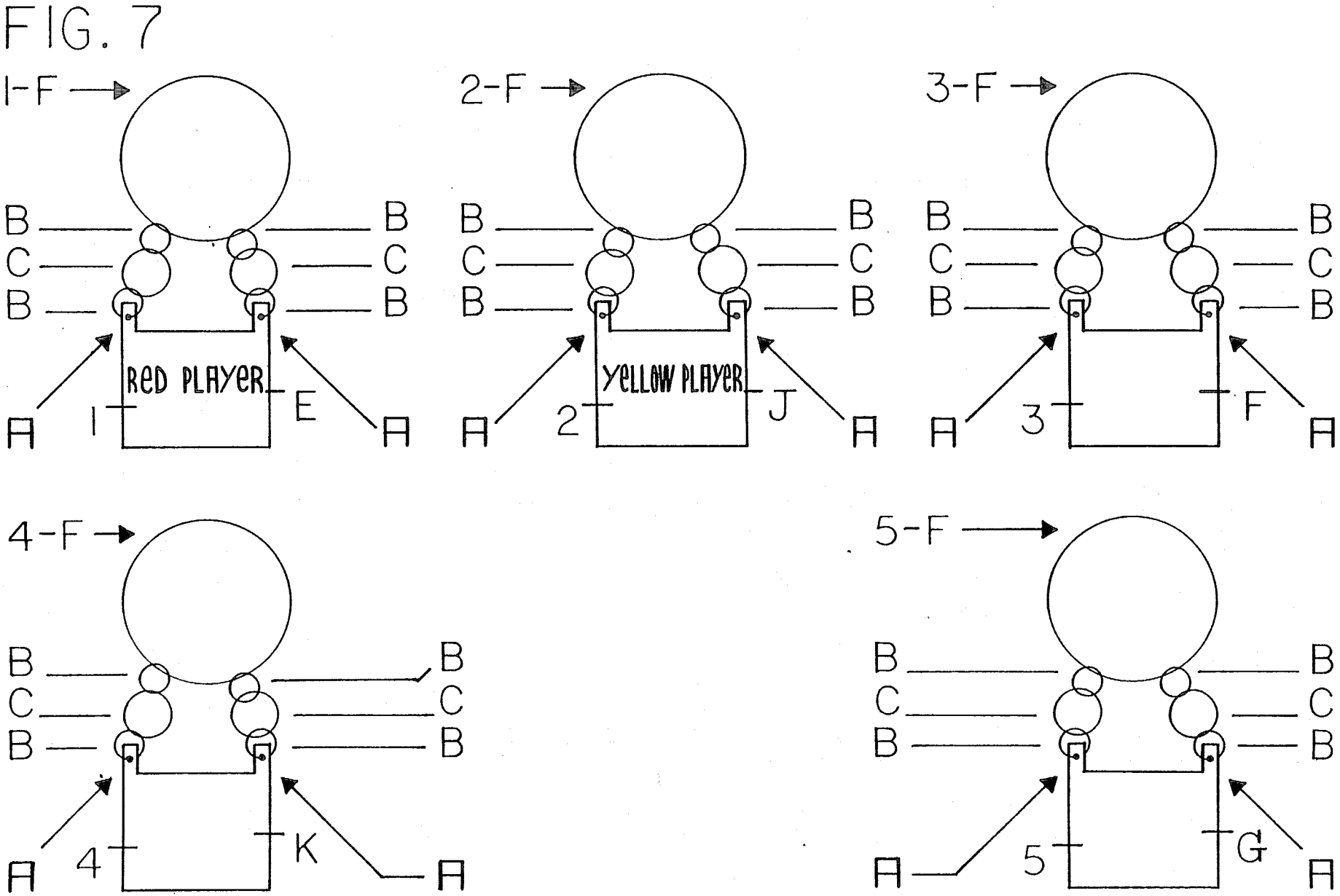
FIG. 7 is a cross-sectional engineering drawing that shows the front view and the rear view simultaneously of each player's ID tag.
Figure 7:
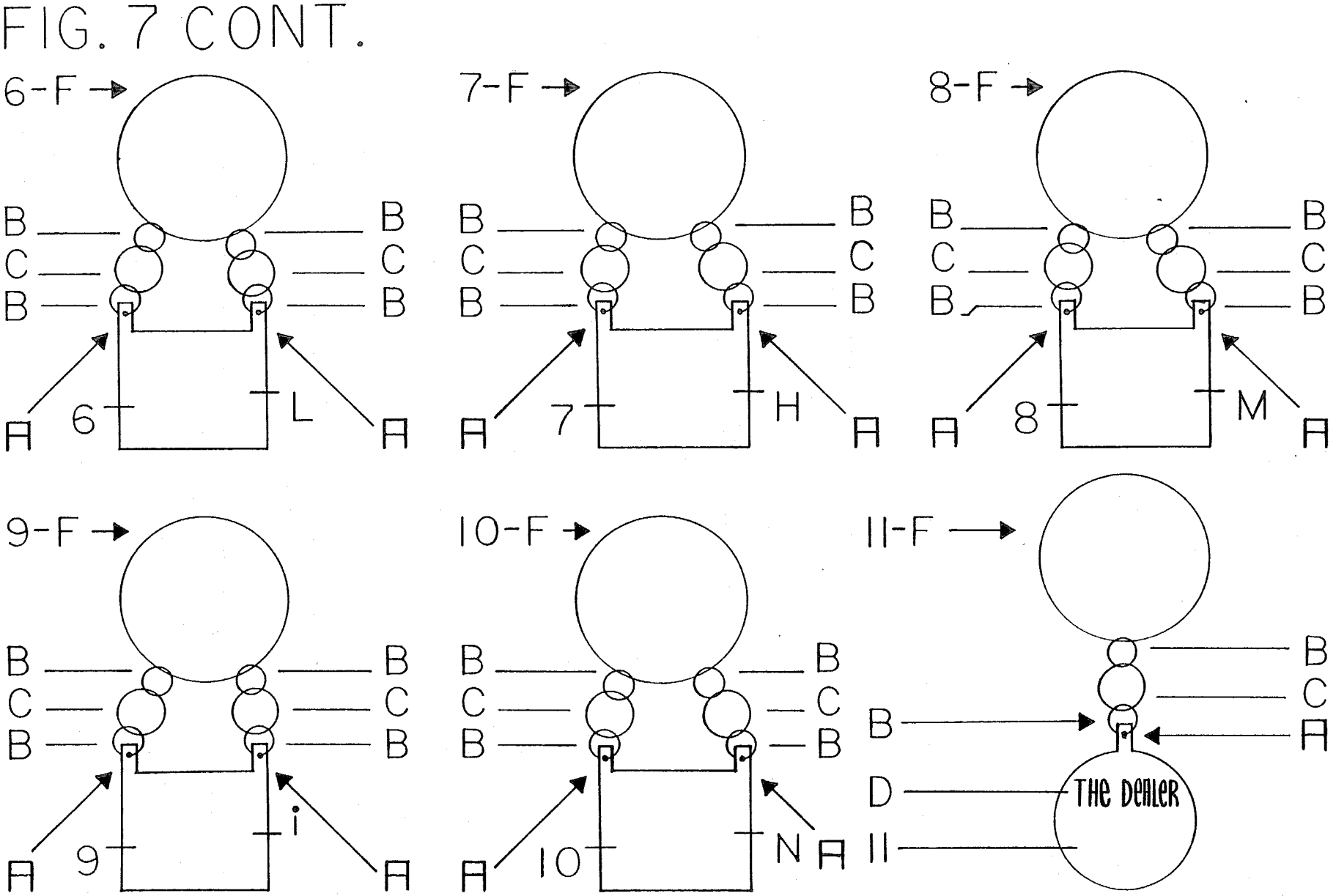

FIG. 7 shows how each one of the ten player's ID (identification) tags should appear and the last cross-sectional engineering drawing in FIG. 7 shows how the dealer's ID (identification) tag should appear. The reference characters 1-F-11-F shows how each one of the eleven belts should appear. Each said belt is extremely narrow, (very thin too) and made of inexpensive cloth (cotton, nylon, or dacron polyester . . . or even 100% polyester) with either a cheap metal or a plastic buckle so the 18" said cloth can fit comfortably around any size of a card player's neck. The said cloth should contain ten holes so either one of the said holes can be fastened to the said buckle. The said cloth should also contain 3 loops so after the belt has been fastened either one of the 3 loops can stop the tip (or unused part of the cloth) from hanging down too low beneath the card player's neck. Each player's ID tag contains two separate necks and each said neck is $\frac{1}{2}''$ tall, $\frac{1}{2}''$ wide, and 3/16" thick with a $\frac{1}{4}''$ hole A centered off between it. Therefore, each said tag is $4\frac{1}{2}''$ tall, 5" wide, 3/16" thick, and made of either hard or elastic cardboard with 2 glossy faces, or plastic that is not transparent, or made of rubber with all numbers and alphabets engraved upon both of its faces, or wood with 2 glossy faces. The string to the beads B is made of nylon or cotton and the beads B are made of rubber or cloth while the said string of beads form into a fastened loop the size of a $\frac{1}{2}''$ circle and the thick rubber band C is the size of a 1" circle.

FIG. 7 shows the dealer's ID tag which is the same size and make (reproduction) of a player's ID tag except for its circular-shaped body which is the size of a 4" circle. Because its single neck is $\frac{1}{2}''$ tall, its said body including its said neck would together be $4\frac{1}{2}''$ tall.

Figure 8:
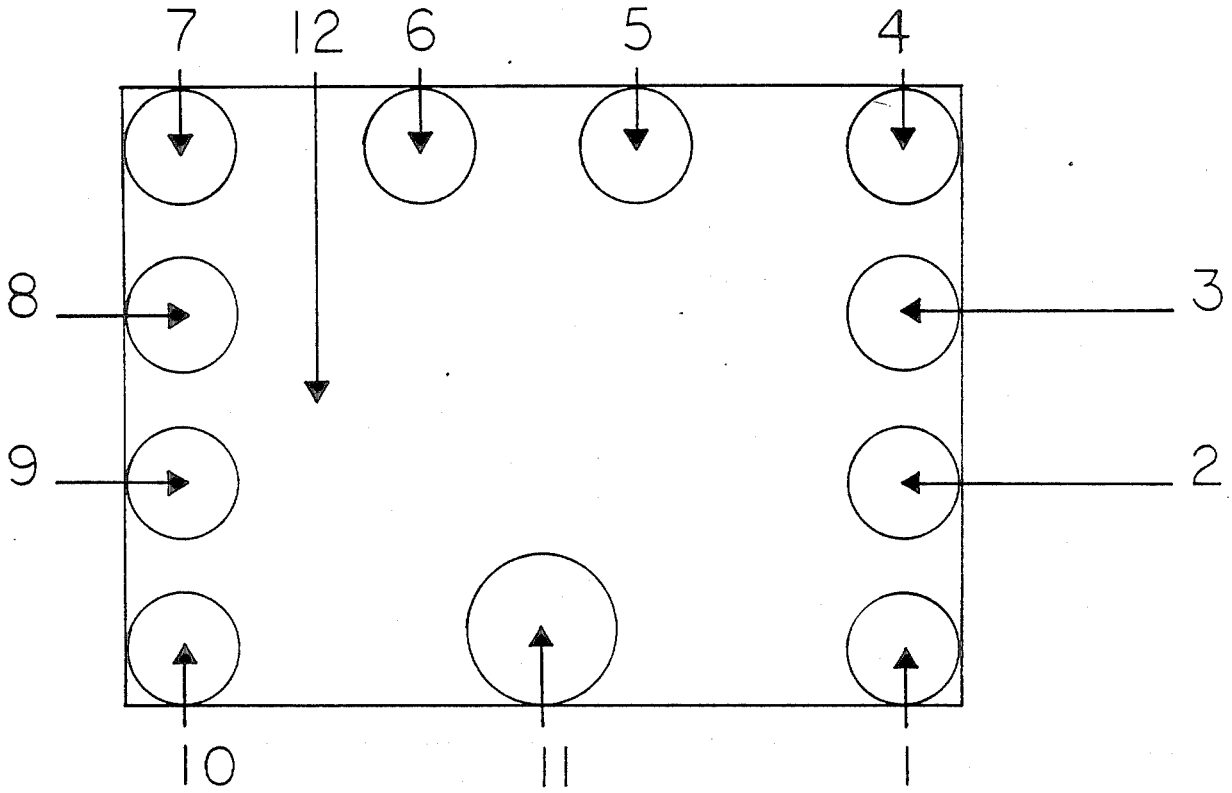
FIG. 8 is a cross-sectional engineering drawing that shows the front view and the rear view simultaneously of the players' assemble card.

FIG. 8 shows both the front view and the rear view simultaneously of the players' assemble card. The card is $5\frac{1}{2}''$ wide, 4" tall, and 1/16"-$\frac{1}{8}''$ thick and the said card is made of cloth being nylon, silk, cotton, rayon, pure polyester, or wool. Upon both faces of the said cloth there are eleven sewn buttons, each one being a certain color. The said card shows each player how to assemble (face the dealer while playing card). FIG. 8 shows that the red player (or the red button) is on the right side of the dealer (white button) during a game. Since the yellow button (reference numeral 2) is on the right side of the red button (reference numeral 1), the yellow player should be seated on the right side of the red player while playing cards. Since the blue button (reference numeral 3) is on the right side of the yellow button (reference numeral 2), the blue player should be seated on the right side of the yellow player, etc.

Only FIG. 9 contains the reference characters written below. Therefore:

A-13—The 1st stick and it is 6" long, $\frac{1}{4}''$ wide, made of hard (thick) plastic, wood, cardboard, or rubber and contains one hole near its tip.

B-13—The 3rd stick and it is made the same way as the 1st stick A-13 except that it, B-13, is 12" long, contains 2 holes with each said hole near each one of both of its tips, and it, B-13, fits under the flat bottom of the stick-tray D-13.

C-13—The 2nd stick and it is made the same way as the 1st stick A-13 except that it, C-13, contains 2 holes with each said hole near each one of both of its tips.

D-13—The flat bottom of the stick-tray with the said flat bottom being 2" wide and 2" long.

E-13—One of the 3 low rims when each one is $\frac{1}{4}''$ tall.

F-13—The buttonhead rivet which holds the flat bottom of the stick-tray D-13 tightly to the 3rd stick B-13. The said rivet should allow any dealer to revolve the said bottom clockwise or counterclockwise so the mouth of the stick-tray i-13 can point in the proper direction for any right-handed or left-handed dealer(s) to pour colored coins FIG. 6 through the said mouth so the said coins will fall through each or any one of the 4 openings 5-G of the colored bank FIG. 10.

G-13—The buttonhead rivet which holds the 1st stick A-13 tightly to the 2nd stick C-13. The said rivet should allow any dealer to fold both said sticks so the stick-tray will be 12" shorter or to fold the 1st stick A-13 so the stick-tray will be 6" shorter or to make both said sticks stand out straight like a horizontal line without bending when any dealer swings or picks up the stick-tray.

H-13—The buttonhead rivet which holds the 2nd stick C-13 to the 3rd stick B-13. The said rivet should allow any dealer to fold or make stand out straight (without bending) the 2nd stick C-13.

i-13—The mouth of the stick tray so colored coins FIG. 6 can be poured through the said mouth.

Figure 9:
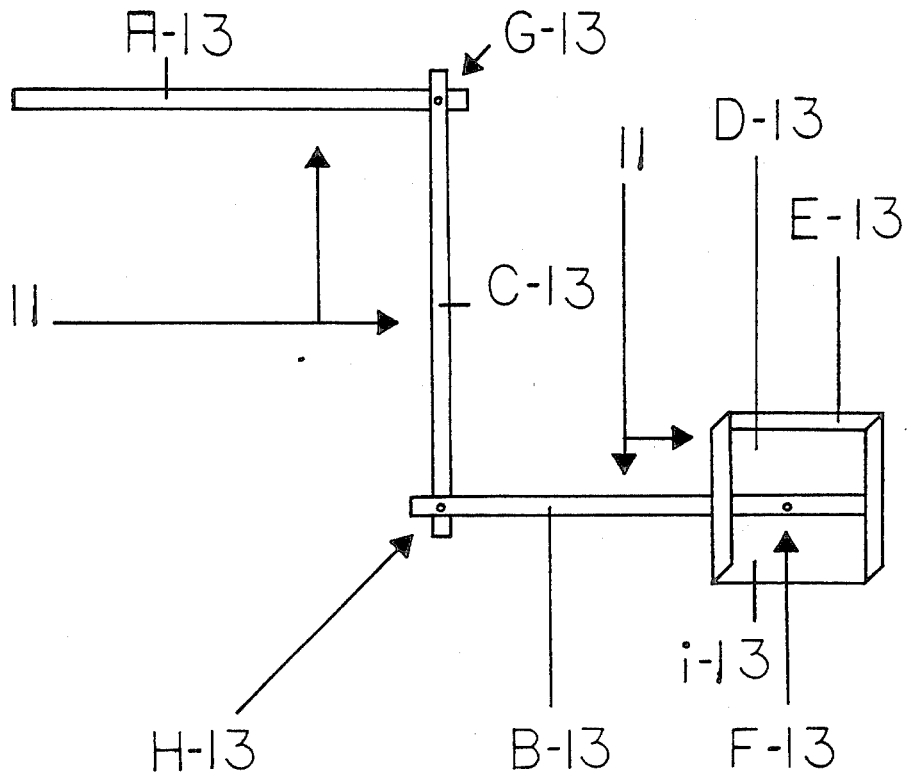
FIG. 9 is a perspective view of the dealer's colored stick-tray when looking at the stick-tray from the top left side.

The flat bottom D-13, each one of the 3 low rims E-13, and the mouth i-13 of the stick-tray FIG. 9 is made of the same kind of material as the 1st stick A-13 and each one of the 3 buttonhead rivets can be made of steel, copper, plastic, or rubber.

Figure 10:
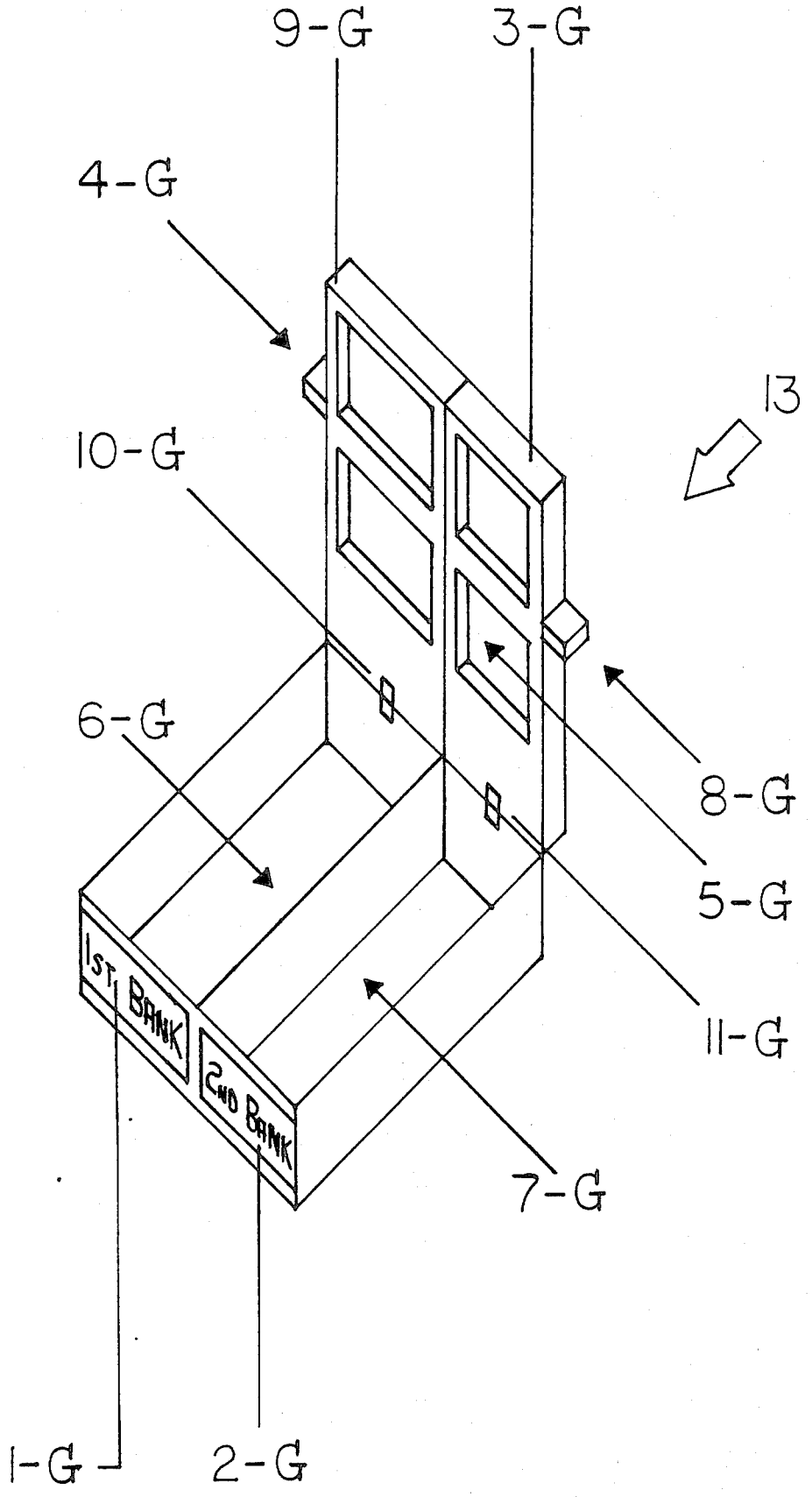
FIG. 10 is a perspective view of the colored bank already opened when looking at the bank from the top right side.

FIG. 10 shows the colored bank which is made of plastic, wood, rubber, steel, or cardboard, both the lid that covers only the 1st bank 9-G and the bottom or floor of the 1st bank 6-G is 5" wide and $10\frac{1}{2}''$ long. Both the lid that covers only the 2nd bank 3-G and the bottom or floor of the 2nd bank 7-G is 4" wide and $10\frac{1}{2}''$ long. Therefore, the colored bank is 9" wide, $10\frac{1}{2}''$ long, and 4" tall. Each one of the 2 rectangular-shaped openings within the 1st lid 9-G is 4" wide and 3" long and each one of the openings (two) within the 2nd lid 3-G is 3" wide and 3" long. Each one of the 2 handles 4-G and 8-G is 1" wide and $\frac{1}{2}''$ tall. The colored bank FIG. 10 can be of any thickness. The upper rectangular-shaped openings of 5-G are made $\frac{1}{2}''$ from the top of both lids 9-G and 3-G. Both lower rectangular-shaped openings of 5-G are made 1" underneath both said upper openings and 3" above the bottom of both said lids.

The color-coded card game is easy to learn how to play it as long as the dealer or each one of the players can remember that there are 5 different kinds of symbols in deck number two FIG. 2 which contains 50 instruction cards. On each instruction card there is one symbol: the symbol "STAR" means to sell 2 cards to a special player; the symbol "BALL" means to buy 2 cards from a special player; the symbol "TRIANGLE" means to trade 2 cards with a special player; the symbol "OCTAGON" means to owe 2 cards to a special player; and the symbol "WALL" (which is a vertical rectangle) means to win 2 cards from a special player. A player is suppose to keep his *cards* that equal 3 *matching* whole colors after the player shows the said cards to the dealer to win all of the colored coins FIG. 6 from the 1st and/or 2nd bank. The player will not keep the said cards if the instruction card(s) forces him to lose the said cards that made him win the said coins.

HOW TO DEAL THE CARDS IN DECK NUMBER ONE

The red player will receive all of his cards firstly; the yellow player will receive all of his cards secondly; the blue player will receive all of his cards thirdly, etc. until the last player receives all of his cards at one time. The players' assemble card FIG. 8 shows each player how to be seated to receive cards from the dealer who deals counterclockwise (beginning with the red player and ending with the last player or black player). The dealer is not a player and does not deal cards to himself. The dealer deals cards only from deck number one to each player and keeps all cards in deck number two to flip over one at a time so each player can follow the instructions of each card in deck number two. The cards will be dealt face-down.

| IF THERE IS A DEALER AND: | EACH PLAYER WILL RECEIVE: |
|---|---|
| 2 PLAYERS | 30 CARDS, |
| 3 PLAYERS | 20 CARDS, |
| 4 PLAYERS | 15 CARDS, |
| 5 PLAYERS | 12 CARDS, |
| 6 PLAYERS | 10 CARDS, |
| 10 PLAYERS | 6 CARDS. |

HOW TO UNDERSTAND THE CARDS IN DECK NUMBER ONE

In this color-coded card game *the color white is not a color* because it has *no* value and it equals *nothing.* The dealer's ID (identification) tag is white (the last tag in FIG. 7) and the dealer's colored stick-tray is white FIG. 9 and neither one of the said card game toys has value: both equals nothing. All colors, except for the color white, have value and equal something. Therefore: in FIG. 1 there are 10 rows of cards with 6 cards in each row. The 1st–5th row of cards contains 30 whole-colored cards because each card is one whole color that equals one whole color. The 6th–8th row of cards and the first 2 cards (from left to right) in the 9th row are 20 single ½-colored cards because each card contains ½ of a whole color since the color white on each card is not counted as being a color and each one of the said cards equals ½ of a whole color. The 3rd–6th card in the 9th row (from left to right) and the 10th row of cards contains 10 double ½-colored cards because each card contains a double color that is 2 different colors and each one of the 2 different colors equals ½ of a whole color. There are 5 matching whole colors in each one of the ten different kinds of matching colors to deck number one and a player must have 3 *matching* whole colors to win all of the colored coins FIG. 6 from the 1st and/or second bank 6-G and 7-G in FIG. 10. A color on a card matches the color on another card when both cards have the same color. Example: red matches only red, green matches only green, yellow-green matches only yellow-green, etc. Two single ½-colored cards that have the same color equal 1 matching whole color, and one single ½-colored card and one double ½-colored card that have the same color equal 1 matching whole color. Two double ½-colored cards that have the same color equals 1 matching whole color, two whole-colored cards that have the same color equal 2 matching whole colors, and 3 whole-colored cards that have the same color equals 3 matching whole colors. Examples: in FIG. 1 let us use the 1st card in the 1st row (equals one whole color in red), the 1st 2 cards in the 6th row (from left to right) that together equal two ½'s of a whole color or one whole color in red, the 3rd card in the 9th row (from left to right) and the 6th card in the 10th row (from left to right) that together equal two ½'s of a whole color or one whole color in red. The 5 cards together equal 3 matching whole colors in red. In FIG. 1 let us use the 4th and 5th card in the 1st row (from left to right) that together equal two whole colors in yellow, and the 3rd and 4th card in the 9th row (from left to right) that together equal two ½'s of a whole color or one whole color in yellow. The 4 cards together equal 3 matching whole colors in yellow, etc. Any number of cards can be used to equal 3 matching whole colors and either one of the 2 colors on a double ½-colored card can be used to try to match the color(s) on the other card(s).

HOW TO UNDERSTAND THE CARDS IN DECK NUMBER TWO

In FIG. 2 notice that there are 8 rows of cards with 6 cards in each row and the 9th row contains only 2 cards. In FIG. 3 notice that there are 3 rows of cards with 4 cards in the 1st row, 3 cards in the 2nd row, and 3 cards in the 3rd row. FIG. 2 contains 50 and FIG. 3 contains 10 of the 60 cards in deck number two. The 50 cards in FIG. 2 are called "iNSTRUCTION CARDS" because each said card instructs 1 player to buy 2, sell 2, trade 2, owe 2, or win 2 cards from the other player. The 10 cards in FIG. 3 are called "WINNING CARDS" because each said card shows when 1 out of a maximum of 9 players can win from the 1st or 2nd bank. Look at the 1st card in the 1st row of FIG. 3. The card contains 3 rows of small squares with 3 small squares in each row and 1 big square below the 9 small squares. The big square is colored red 1. That means that one out of the maximum of 9 players (even if 10 players are in the game) can win all of the colored coins from the 1st bank (and if the 1st bank is already empty, the said one player can win it from the 2nd bank) if the said one player can show the dealer any number of cards that equal 3 matching whole colors in red. The colors on the small squares show what players can win the coins. For example, on the face of the said card the 1st row of small squares is yellow 2, blue 3, and brown 4; the 2nd row is green 5, yellow-green 6, and orange 7; the 3rd row is carnation pink 8, violet 9, and black 10. The 9 different colors of the squares mean that one of the 9 players: the yellow player according to 2, the blue player according to 3, the brown player according to 4, the green player according to 5, the yellow-green player according to 6, the orange player according to 7, the carnation-pink player according to 8, the violet player according to 9, or the black player according to 10 can win all of the coins from the 1st or 2nd bank if one of the said 9 players can show the dealer any number of cards that equal 3 matching whole colors in red. Why red? Because the said big square is red 1. The 1st card in FIG. 3 (from left to right) shows that any player except the red player can win with 3 matching whole colors in red 1. The 2nd card in FIG. 3 (from left to right) shows that any player except the yellow player can win with 3 matching whole colors in yellow 2. The 3rd card in FIG. 3 (from left to right) shows that any player except the blue player can win with 3 matching whole colors in blue 3, etc. It is the responsibility of the dealer alone to flip over cards from deck number 2 so each one of the said cards can be shown to the players. Each time the dealer flips over a winning card from deck number 2 one of the players can win. A player can win from both banks in any separate games, but a player can not win from both banks at the same time. A player must win from the 1st bank if it is not empty before he can win from the 2nd bank. After a player wins from the 2nd bank the game ends. In FIG. 2 each one of the 50 instruction cards contains one symbol and one background. The symbol "STAR" means to sell. Look at the 1st card in the 1st row of FIG. 2 (from left to right). The red star 1-A means that the red player must sell 2 cards for 2 colored coins to the yellow player because the background on the said card is yellow 2. The red player must give any 2 cards that he (the red player) is already holding to the yellow player who must give 2 yellow colored coins to the dealer who will use the stick-tray FIG. 9 to receive the 2 coins and drop the 2 coins into the 2nd bank. Look at the 2nd card in the 1st row of FIG. 2 (from left to right). The blue star 3-A means that the blue player must sell 2 cards for 2 colored coins to the brown player because the background on the said card is brown 4. The blue player must give any 2 cards that he (the blue player) is already holding to the brown player who must give 2 brown colored coins to the dealer who will use the stick-tray to receive the 2 coins and drop the 2 coins into the 2nd bank, etc. Look at the 5th card in the 7th row of FIG. 2 (from left to right). The red ball 1-e means that the red player must buy 2 cards for 2 colored coins from the yellow player because the background on the said card is yellow 2. The symbol "BALL" means to buy. The red player must give 2 red colored coins to the dealer who will use the stick-tray to receive the 2 coins and drop the 2 coins into the 2nd bank. Then, the yellow player must give any 2 cards that he (the yellow player) is already holding to the red player. Look at the 6th card in the 7th row of FIG. 2 (from left to right). The yellow ball 2-e means that the yellow player must buy 2 cards for 2 colored coins from the blue player because the background on the said card is blue 3. The yellow player must give 2 yellow colored coins to the dealer who will use the stick-tray to receive the 2 coins and drop the 2 coins into the 2nd bank. Then, the blue player must give any 2 cards that he (the blue player) is already holding to the yellow player, etc. After a player receives 2 cards from another player the 2 cards belong to the player who received both of the said cards and the player can not refuse to accept either one of the 2 cards already received. Look at the 3rd card in the 4th row of FIG. 2 (from left to right). The red triangle 1-C means that the red player must trade any 2 cards with the yellow player because the background on the said card is yellow 2. To trade, the red player will hand (give) any 2 cards to the yellow player who will, at the same time, hand (give) any 2 cards to the red player. The symbol "TRIANGLE" means to trade. Look at the 4th card in the 4th row of FIG. 2, from left to right. The yellow triangle 2-C means that the yellow player must trade any 2 cards with the blue player because the background on the said card is blue 3. To trade, the yellow player will hand (give) any 2 cards to the blue player who will, at the same time, hand (give) any 2 cards to the yellow player. Look at the 5th card in the 2nd row of FIG. 2 (from left to right). The red octagon 1-B means that the red player owes any 2 cards that he (the red player) is already holding to the yellow player because the background on the said card is yellow 2. The symbol "OCTAGON" means to owe. The red player must hand (give) 2 red colored coins to the yellow player. The yellow player can then receive the 2 cards owed to him by the red player anytime before the game ends if the yellow player returns the 2 red colored coins to the red player. Once the red player receives the 2 red colored coins from the yellow player, he (the red player) must hand (give) the 2 cards to the yellow player or he (the red player) loses the game instantly. The yellow player can not use the 2 red colored coins for any other reason outside of returning the 2 said coins to the red player. If the yellow player is still holding the 2 said coins after the game had ended, the yellow player will have to return the 2 said coins to the red player without receiving any of the 2 cards that were owed to him by the red player. Look at the 6th card in the 2nd row of FIG. 2 (from left to right). The yellow octagon 2-B means that the yellow player owes any 2 cards that he (the yellow player) is already holding to the blue player because the background on the said card is blue 3. The yellow player must hand (give) 2 yellow colored coins to the blue player. The blue player can then receive the 2 cards owed to him by the yellow player anytime before the game ends if the blue player returns the 2 yellow colored coins to the yellow player. The instant the yellow player receives the 2 yellow colored coins from the blue player, he (the yellow player) must hand (give) the 2 cards to the blue player or he (the yellow player) loses the game instantly. The blue player can not use the 2 yellow colored coins for any other reason outside of returning the 2 said coins to the yellow player. If the blue player is still holding the 2 said coins after the game has ended, the blue player will have to return the 2 said coins to the yellow player without receiving any of the 2 cards that were owed to him by the yellow player.

Special note: if the said yellow player loses the game before he can return the 2 red colored coins to the red player and the whole game has not ended yet, he (the said yellow player) will have to return the 2 red colored coins to the red player immediately, even if the red player has already lost the game. The said yellow player could have returned the 2 red colored coins instantly and instantly received the 2 cards owed to him by the red player if he (the said yellow player) wanted his 2 cards immediately.

Special note: if the said blue player loses the game before he can return the 2 yellow colored coins to the yellow player and the whole game has not ended yet, he (the said blue player) will have to return the 2 yellow colored coins to the yellow player immediately, even if the yellow player has already lost the game. The said blue player could have returned the 2 yellow colored coins instantly and instantly received the 2 cards owed to him by the yellow player if he (the said blue player) wanted his 2 cards immediately. Look at the 1st card in the 6th row of FIG. 2 (from left to right). The red vertical rectangle is a red "WALL" 1-D and the said wall means that the red player wins 2 cards from the yellow player because the background on the said card is yellow 2. The yellow player must give any 2 cards that he (the yellow player) is already holding to the red player. If the yellow player can not give the 2 cards to the red player, he (the yellow player) loses the game instantly. The symbol "WALL" means to win (2 cards). Look at the 4th card in the 7th row of FIG. 2 (from left to right). The black vertical rectangle is a black "WALL" 10-D and the said wall means that the black player wins 2 cards from the red player because the background on the said card is red 1.

WHAT TO DO WHEN THERE IS/ARE THE MISSING PLAYER(S)

It is the dealer's responsibility to show a player who to buy from, sell to, trade with, owe to, or win from when the player on the background of any instruction card FIG. 2 is missing from the game because the missing player has either already lost the game before the whole game has ended or was never in the game being played. Whenever a player can not buy, sell, trade, owe, or win from/to the missing player, the player will have to do it with the next player. Look at the players' assemble card in FIG. 8. Notice how the players in FIG. 8 are arranged or seated counterclockwise from the dealer 11 in FIG. 8. If there is only a dealer and one player left in the whole game, the one remaining player wins instantly or automatically all of the colored coins from both or either bank(s). Here is an example about the next player: suppose the dealer flips over the 5th card in the 2nd row of FIG. 2. The red octagon 1-B instructs (tells) the red player to owe 2 cards to the yellow player because the background on the card is yellow 2. If the red player is missing from the game, the dealer will ignore the said card and flip over the next instruction or winning card in deck number two. If the yellow player is missing from the game but the red player is still in the game, the red player shall owe 2 cards to the next player (counterclockwise on the players' assemble card in FIG. 8) that is the blue player 3 in FIG. 8. If there is no blue player, the red player shall owe 2 cards to the next player that is the brown player 4 in FIG. 8, etc. Here is another example: suppose the dealer flips over the 3rd card in the 2nd row of FIG. 2. The violet star 9-A instructs (tells) the violet player to sell 2 cards to the black player because the background on the card is black 10. If the violet player is missing from the game, the dealer will ignore the said card and flip over the next card in deck number two. If the black player is missing from the game but the violet player is still in the game, the violet player shall sell 2 cards to the next player (counterclockwise on the players' assemble card in FIG. 8) that is the red player 1 in FIG. 8. If there is no red player, the violet player shall sell 2 cards to the next player that is the yellow player 2 in FIG. 8, etc.

HOW A PLAYER LOSES THE GAME AND WHAT THE DEALER SHOULD DO

A player loses the game before the whole game has ended if the player does not have at least 2 cards and at least any 2 colored coins left when the dealer instructs (tells) the player to trade 2 cards, buy 2 cards, sell 2 cards, or owe 2 cards (before the other player asks for the 2 cards owed). A player does not lose the game if the player has less than 2 cards and/or 2 colored coins when the dealer instructs (tells) the player to win 2 cards. Also, a player does not lose the game if the player has less than 2 cards and/or 2 colored coins if the dealer does not instruct (tell) the player to trade, buy, see, or owe 2 cards before the player plays long enough to have at least 2 cards and 2 colored coins. When a player loses the game before the whole game has ended, the player must give all of his cards if any to the dealer who will place the said cards face-down under the cards from deck number two which are already face-down and have already been flipped over before being placed face-down and the dealer will drop the said coins if any into the 2nd bank. If no player wins from the 1st and/or 2nd bank after the dealer flips over the last card in deck number two FIGS. 2 and 3, the dealer will win all of the colored coins from the bank(s) that is/are not empty.

A NEW DEALER FOR EACH GAME

When players are not gambling for real money, there will be a new dealer for each game. Look at the players' assemble card FIG. 8. The dealer 11 in FIG. 8 for the 1st game is shown. The dealer for the 2nd game (looking at the players counterclockwise) shall be the red player 1 in FIG. 8. The dealer 11 in FIG. 8 shall give his dealer's ID tag to the red player 1 in FIG. 8 who shall give his (the red player's) ID tag to the yellow player 2 in FIG. 8 who shall give his (the yellow player's) ID tag to the blue player 3 in FIG. 8 who shall give his (the blue player's) ID tag to the brown player 4 in FIG. 8 who shall give his (the brown player's) ID tag to the green player 5 in FIG. 8, etc. The dealer 11 in FIG. 8 for the 1st game will receive a player's ID tag from the 10th player or from whoever is the last player seated on the left side of the dealer. To make a long story short, the dealer and the players must move the ID tags counterclockwise after each game. That means that the dealer will always become a player in the next game(s). The dealer for the 3rd game (looking at the players counterclockwise) shall be the yellow player 2 in FIG. 8. The dealer for the 4th game shall be the blue player 3 in FIG. 8, etc.

Special note: if the next player (looking at the players counterclockwise on the players' assemble card FIG. 8) does not want to be the new dealer for the game because the said player does not know how or does not want to do everything a new dealer should do, then the next player after the said player shall be the new dealer. Example: if the red player 1 in FIG. 8 does not want to be the new dealer, the yellow player 2 in FIG. 8 shall deal. If the yellow player does not want to be the new dealer, the blue player 3 in FIG. 8 shall deal. If the blue player does not want to be the new dealer, the brown player 4 in FIG. 8 shall deal, etc. If not one out of all the players want to be the new dealer (and that can rarely happen), the dealer of the last game can be the new dealer.

Special note: if players are legally gambling for real dollar bills, the colored coins can be exchanged for real dollar bills from the person who holds the money before the game starts. A new box (containing 100 colored coins) can be used for each game, only when players are legally gambling.

4 EASY STEPS TO PLAY THE COLOR-CODED CARD GAME

STEP 1: each person entering any game must wear an ID (identification) tab around the neck. The smallest number of persons entering any game must be a dealer and 2 players (a red player and a yellow player). The largest number of persons entering any game must be a dealer and 10 players. All persons (children or adults)

entering the game must be seated according to the seating arrangement of the players' assemble card FIG. 8.

STEP 2: each player will receive 10 coins for each or any single game. The coins must be the same color of the player. Example: the red player will receive 10 red colored coins, the yellow player will receive 10 yellow colored coins, the yellow-green player will receive 10 yellow-green coins, etc. Each player will give 4 colored cons for the dealer to drop into the 1st bank. Then, each player will give 2 colored coins for the dealer to drop into the 2nd bank. The dealer will take and keep 1 colored coin from the 1st bank as a reward or payment for being the dealer.But after the game has ended the dealer will return the said coin to the player of the next game if the players were not legally gambling.

STEP 3: the dealer will shuffle the cards in both decks, keeping deck number one separated from deck number two. The cards in deck number one are ¼" taller than the cards in deck number two which are ¼" wider than the cards in deck number one, making it easy to separate the cards because when the card(s) need to be separated, ¼" of the card(s) shall be conspicuous.

STEP 4: the dealer will flip over one card at a time from deck number two and give each player enough time to see, follow the instruction, or win from each flipped-over card. If the flipped-over card is an instruction card, the 2 players must follow the instruction on the card and if the flipped-over card is a winning card, one player must show the dealer enough cards that equal 3 matching whole colors if the one player can win. The said one player will keep the said cards that equal 3 matching whole colors after using the said matching cards to win from the 1st and/or 2nd bank, unless the instruction card(s) flipped over later instruct(s) (tell or tells) the said one player to sell, owe, or trade 2 cards which may force the said one player to get rid of the said matching cards. Since matching cards that win from the 1st and/or 2nd bank can win only one time per game, the said one player should sell, owe, or trade the said matching cards as soon as possible when the instruction card(s) instruct(s) or tell(s) him to sell, owe, or trade 2 cards. The dealer should turn each flipped-over card face-down after the players have seen, followed the instruction, or won/could not win from the flipped-over card. Remember that a flipped-over card is placed face-up on the table before being turned face-down. The dealer will stack all flipped-over cards upon each other, keeping the flipped-over cards from deck number two always separated from the other cards in deck number two that have not been flipped over yet.

SKILL IN THE GAME

If a player has less than 2 colored coins left, the player who his still holding 2 of the colored coins from the player who has less than 2 colored coins left should not or can not (according to game rules) return the 2 colored coins (for 2 cards owed) until the player has at least 2 colored coins left. Here is an example: if the dealer flips over the 5th card in the 7th row of FIG. 2 (from left to right) the red player will lose 2 colored coins by having to buy 2 cards from the yellow player. If the dealer flips over the 5th card in the 2nd row of FIG. 2 (from left to right) the red player will lose 2 more colored coins by having to owe 2 cards to the yellow player. That means that the red player will have less than 2 colored coins left because the red player received 10 colored coins (red ones) to enter the game. Since 4 of the said coins were dropped into the 1st bank by the dealer, 2 of the said coins were dropped into the 2nd bank by the dealer, 2 of the said coins were lost by having to buy 2 cards, and 2 of the coins were lost by having to owe 2 cards, the red player has no red colored coins left. The yellow player can not (according to game rules) return 2 of the red colored coins (in exchange for 2 cards owed) to the red player yet because the red player has less than 2 colored coins left. The red player will lose the game if an instruction card instructs (tells) the black player to sell 2 cards to the red player (see the 4th card in the 2nd row of FIG. 2) because the red player does not have at least any 2 colored coins left. The yellow player can return the 2 red colored coins to the red player to receive the 2 cards owed to him (the yellow player) only if or when the red player has at least any 2 colored coins left, even if the red player does not have at least 2 cards left. The red player will lose the game instantly if, after having at least any 2 colored coins (2coins, each one being any color), can not pay (give) the 2 cards owed (that are already asked for) because he (the red player) has less than 2 cards. In other words, any player loses the game if, after receiving the 2 coins owed, fails to play (give) the 2 cards owed to the player who returned the 2 coins.

EVERYTHING ABOUT THE SERIAL NUMBERS IN THE GAME

There will be only one kind of serial number for each whole color-coded card game and the one kind of serial number will appear only on the reverse side or back of each card in deck number one O and P in FIG. 4 and deck number two O and P in FIG. 5 and on both the front and the back of each colored coin O and P in FIG. 6. Example: The 1st color-coded card game produced by the manufacturer should contain only the serial number 1A. The second game produced should contain only the serial number 2A. The third game produced should contain only the serial number 3A, etc. Written below is an example of how serial numbers can appear:

1A—1,000,000,000,000A.
1B—1,000,000,000,000B.
1C—1,000,000,000,000C, etc. to:
1Z—1,000,000,000,000Z.

Serial numbers appear on the back of each card and on both sides of each colored coin to prevent card-sharps, poor gamblers, and kleptomaniacs from cheating in the game by trying to slip illegal cards and coins into the game to win illegally from the 1st and/or 2nd bank or by trying to steal coins to continue playing in the game. It is the dealer's responsibility to check the one kind of serial number on each card whenever a player shows enough matching cards to win from the 1st and/or 2nd bank so the dealer can make certain that the player is using the cards which contain the right one kind of serial number for the game being played, because the serial number in the game prevents cheating or makes it almost impossible for a player to win by cheating. The dealer should check (look at) the serial number on a player's colored coins if the player arouse suspicion by seeming to have too many colored coins.

HAVING PROOF ABOUT WHO OWES WHO 2 CARDS

Each time the dealer flips over an instruction card FIG. 2 which contains an octagon (meaning a player owes 2 cards to another player), the dealer should, after the player (who the 2 cards are owed to) receives the 2 colored coins, place the said card face-up under all of the other cards in deck number 2 which have not been flipped over yet. By doing that, the dealer will know and have proof about any player who owes 2 cards to another player so there will be no misunderstanding or argument in the game on who owes who 2 cards. If a player refuses to receive the 2 colored coins and accepts the 2 cards owed before the dealer flips over the next card in deck number 2 or if a player accepts the 2 colored coins but instantly returns the 2 colored coins to the player and accepts the 2 cards owed "BEFORE" the dealer flips over the next card in deck number 2, it will not be necessary for the dealer to place the said instruction card face-up. Instead, the dealer should place the said instruction card the same way he/she (the dealer) places all other cards that have already been flipped over: face-down under all of the cards in deck number 2 that have already been flipped over and placed face-down. Why? Because nobody owes somebody.

THE BEST WAY TO USE THE COLORED STICK-TRAY

The colored stick-tray FIG. 9 is a tray which contains 3 sticks and the 1st stick A-13 and/or the 2nd stick C-13 can be folded to be shorter so the dealer can hold the stick-tray to receive colored coins FIG. 6 from the players who are close by or the said 1st stick and/or the said 2nd stick can be unfolded to stand out straight like a horizontal line to be longer so the dealer can hold the stick-tray near players who are faraway.

The invention claimed is:

1. A color-coded card game that contains two decks of cards with five kinds of card game accessories to make it easy for the dealer to control the game by instructing the players according to the color(s) and the symbol on each card, and therefore the game comprises:

DECK NUMBER ONE which contains each matching card that has either one or two colors to match the other matching cards found only in deck number one, DECK NUMBER TWO which contains each instruction card that has one symbol (ball means to buy 2 cards, star means to sell 2 cards, triangle means to trade 2 cards, wall means to win 2 cards, and octagon means to owe 2 cards) and one background (meaning the player who is the color of the symbol must buy, sell, trade, win, or owe 2 cards from/to the player who is the color of the said background) and contains each winning card that has ten colors, each color on a small separate square except for the single color on a big separate square below the said small squares when one of the players who is one of the different colors on the 9 small squares can win all of the colored coins from the first and/or second bank if the said one player has cards that equal 3 whole matching colors the same color of the big separate square on the winning card, THE COLORED COINS when each said coin, after being dropped into the colored bank, will be won by the player(s) and rarely by the dealer(s) and each one of the said coins can be handed to the dealer while each color of a coin refers to a certain player who is the same color of the coin, THE ID (identification) TAGS to identify each player and the dealer because each ID tag is a certain color so each player can be a certain color (red player, blue player, etc.), THE PLAYERS' ASSEMBLE CARD to show the players how to be seated around the dealer and how to find the next player to buy, sell, trade, win, or owe 2 cards from/to when there is at least one missing player, THE COLORED STICK-TRAY for the dealer to use to receive colored coins, especially from the players who are faraway and must hand coins to the dealer, THE COLORED BANK for the dealer to use to drop colored coins into and/or for the players to win colored coins from, AND THE SERIAL NUMBERS on the cards and the colored coins to prevent cheating and discourage any player from trying to cheat in the color-coded card game.

* * * * *

UNITED STATES PATENT AND TRADEMARK OFFICE

CERTIFICATE OF CORRECTION

PATENT NO. : 4,693,480

DATED : September 15, 1987

INVENTOR(S) : Randolph Smith

It is certified that error appears in the above-identified patent and that said Letters Patent is hereby corrected as shown below:

In the Abstract, line 6, "wind" should read -- win --.

Column 3, line 58, after "of" insert -- A --.

Column 4, line 48, "lid" should read -- bank --.

Column 5, line 59, "card)." should read -- cards). --.

Column 6, line 47, ", both" should read -- . Both --.

Column 12, line 1, "see" should read -- sell --.

Column 12, line 64, "tab" should read -- tag --.

Column 14, line 24, "play" should read -- pay --.

Signed and Sealed this

Twelfth Day of April, 1988

*Attest:*

DONALD J. QUIGG

*Attesting Officer*

*Commissioner of Patents and Trademarks*